US005526588A

United States Patent [19]

Freisinger et al.

[11] Patent Number: 5,526,588

[45] Date of Patent: Jun. 18, 1996

[54] ADJUSTMENT DEVICE FOR CONTROLLING THE PIVOT RESISTANCE OF THE SHAFT RELATIVE TO THE SHELL OF A SKI BOOT

[75] Inventors: Henry Freisinger; Heinz Wittmann, both of Vienna, Austria

[73] Assignee: HTM Sport- und Freizeitgeraete Aktiengesellschaft, Schwechat, Austria

[21] Appl. No.: 399,871

[22] Filed: Mar. 7, 1995

[30] Foreign Application Priority Data

Mar. 9, 1994 [AT] Austria ..... 497/94

[51] Int. Cl.[6] ..... A43B 5/04

[52] U.S. Cl. ..... 36/121; 36/120

[58] Field of Search ..... 36/117, 119, 120, 36/121

[56] References Cited

U.S. PATENT DOCUMENTS

| | | | |
|---|---|---|---|
| 4,372,061 | 2/1983 | Pozzobon | 36/117 |
| 4,411,078 | 10/1983 | Bucheder | 36/117 |
| 4,615,128 | 10/1986 | Borsoi | 36/120 |
| 4,928,406 | 5/1990 | Montfort | 36/117 |
| 5,054,215 | 10/1991 | Tonel et al. | 36/117 X |
| 5,067,258 | 11/1991 | Martignago | 36/117 |
| 5,259,127 | 11/1993 | Pallatin | 36/117 |
| 5,343,640 | 9/1994 | Mattiuzzo et al. | 36/120 X |

*Primary Examiner*—J. Ted Kavanaugh
*Attorney, Agent, or Firm*—Flynn, Thiel, Boutell & Tanis

[57] ABSTRACT

A ski boot having a shell and a shaft hinged to the shell for the support of the skier's leg. The shell consists of a lower part enclosing the foot and of a raised shell part. The ski boot has furthermore a device for controlling the pivotal resistance during pivoting of the shaft of the boot relative to the lower part of the shell. The device includes a spacer arranged in a slot on the raised shell part. This spacer is hinged according to the invention slidingly movably on the load arm of a rotatable crank axle arranged in the shaft of the ski boot. The axle includes a power arm carrying an operating member.

10 Claims, 3 Drawing Sheets

ADJUSTMENT DEVICE FOR CONTROLLING THE PIVOT RESISTANCE OF THE SHAFT RELATIVE TO THE SHELL OF A SKI BOOT

FIELD OF THE INVENTION

The invention relates to a ski boot having an adjustment device for controlling the pivot resistance of the shaft relative to the shell of the boot.

BACKGROUND OF THE INVENTION

Such a ski boot with a device for controlling the pivot resistance of the shaft of the boot is known, for example, from the EP-A2 0 350 023. The spacer in this known solution is guided in a slot which widens V-shaped in an upward direction. The spacer is thereby held at a certain height by pressing the spacer, shell of the boot, the shaft of the boot and a washer mounted on the outside of the shaft of the boot against one another. The elevational adjustment of the spacer is done by releasing this compression and subsequently again creating this compression in a first embodiment by means of a screw, in a second embodiment by means of an eccentric lever.

A further embodiment shows that the mounting of the spacer has a bore with an internal thread. The spacer can thus be moved along a vertically extending spindle.

A stepless adjustment of the flexible behavior of the ski boot is possible in a known solution, however, the adjustment values are not defined and it is difficult for the skier to again attain a specific adjustment value. The known devices are expensive to manufacture and are complicated in handling. Moreover, the solution with the spindle has the disadvantage that the reinforcement of the shaft of the boot by the spindle is undesired, and that the device ceases to function when the spindle bends due to the high forces acting onto a ski boot. Furthermore, the shape of the slot is unfavorable in the known solution.

Compared with this, the goal of the invention is to provide the device in a ski boot of the above-mentioned type which is simple and yet sturdy.

SUMMARY OF THE INVENTION

A ski boot having a shell and a shaft hinged to the shell for the support of the skier's leg. The shell consists of a lower part enclosing the foot and of a raised shell part. The ski boot has furthermore a device for controlling the pivotal resistance during pivoting of the shaft of the boot relative to the lower part of the shell. The device includes a spacer arranged in a slot on the raised shell part. This spacer is hinged according to the invention slidingly movably on the load arm of a rotatable crank axle arranged in the shaft of the ski boot. The axle includes a power arm carrying an operating member.

BRIEF DESCRIPTION OF THE DRAWINGS

Further advantages, characteristics and details of the invention will be described in connection with the drawings, in which.

DETAILED DESCRIPTION

Figure 1:
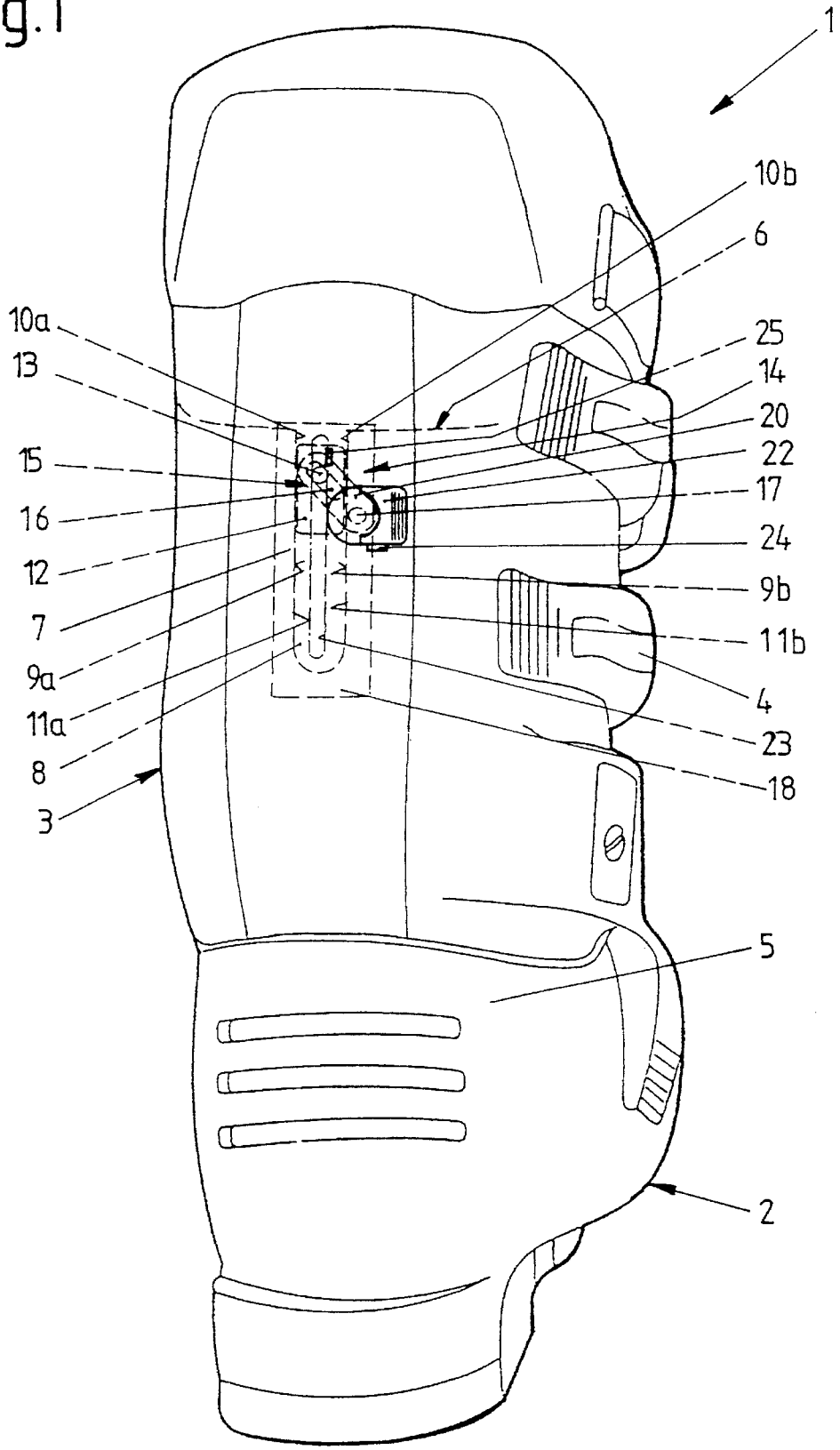
FIG. 1 is an oblique rear view of the ski boot embodying the invention.

FIG. 1 shows a ski boot 1 from the rear. It includes essentially a shell 2 and a shaft 3 of a boot rotatably hinged to the shell. The shaft 3 and the shell 2 can be closed in a conventional manner by buckles, with FIG. 1 showing only the buckles 4 on the shaft 3 of the boot 1. The shell 2 consists of a lower part 5 enclosing the foot and a raised shell part 6 enclosing the lower area of the lower leg of the user. A slot 8 exists in the rear side 7 of the raised shell part 6, around which the shaft 3 of the boot extends. The slot 8 extends approximately vertically, thus along an imaginary line on the raised shell part 6 contained in the vertical plane of symmetry of the ski boot and is open at the top end. The two side edges 9*a*, 9*b* of the slot 8 extend approximately parallel to one another in this exemplary embodiment. They each have a first section 10*a*, 10*b*, which is closer to the open end of the slot 8, and a second section 11*a*, 11*b* closer to the closed end of the slot 8.

Figure 4:
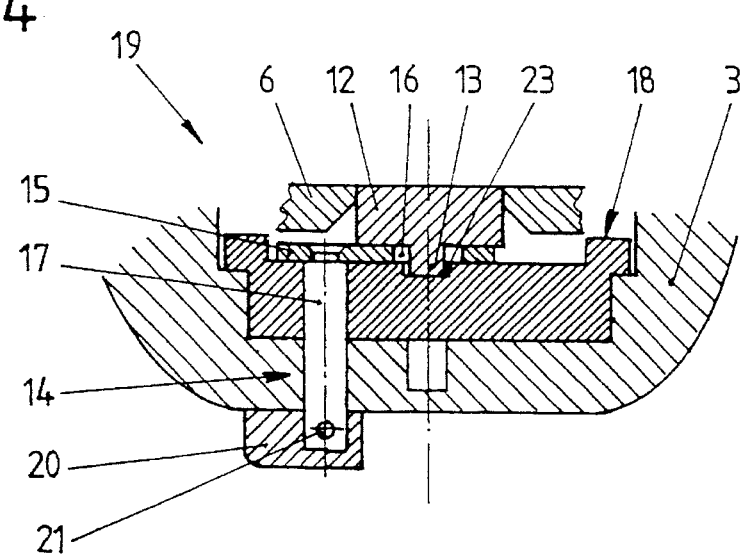
FIG. 4 is a cross-sectional view taken along the line IV—IV of FIG. 2.

A housing 18 is arranged on the shaft 3 of the ski boot 1, in which housing is stored a device identified in its entirety by the reference numeral 19 for controlling the pivot resistance of the shaft 3 of the boot. The device 19 consists essentially of a spacer 12 and a crank 14, as this will be described in greater detail hereinafter. The spacer 12 has a rectangular design and is movably slidingly guided in elevational direction on the two side edges 9*a*, 9*b* of the slot 8. The spacer 12 carries on its upper half a pin 13 directed outwardly toward the shaft 3 of the boot. A free area, for example a groove 23, serving as a guideway is recessed in the housing 18 fastened on the shaft 3 of the boot and receives therein the pin 13. The crank 14 has a rotatable axle 17 which extends through the housing 18 and the shaft 3 of the ski boot 1 (compare FIG. 4). A power arm 20 of the crank 14 is attached to the outer end section of the axle 17 and the load arm 15 of the crank 14 to the inner end section of the axle 17. The power arm 20 and load arm 15 are both fixedly connected to the axle 17 of the crank 14. An operating member 22, for example a handle designed as a flap, is hinged to a swivel axle 21 on the power arm 20 designed as a flattened plate. Such designs are known in ski boots with various adjustment mechanisms, for example the flex-adjustment, canting and, therefore, do not require any further discussion. The mechanism for regulating the forefoot fixation in the ski boot SANMARCO RX9 is mentioned as an example (catalogue 94–95). The load arm 15 of the crank 14 is designed as a plate with a slotted hole 16, through which the pin 13 of the spacer 12 extends. Since the pin 13 extends into the groove 23 of the housing 18, the spacer 12 is guided relative to the shaft 3 of the ski boot 1.

Figure 2:
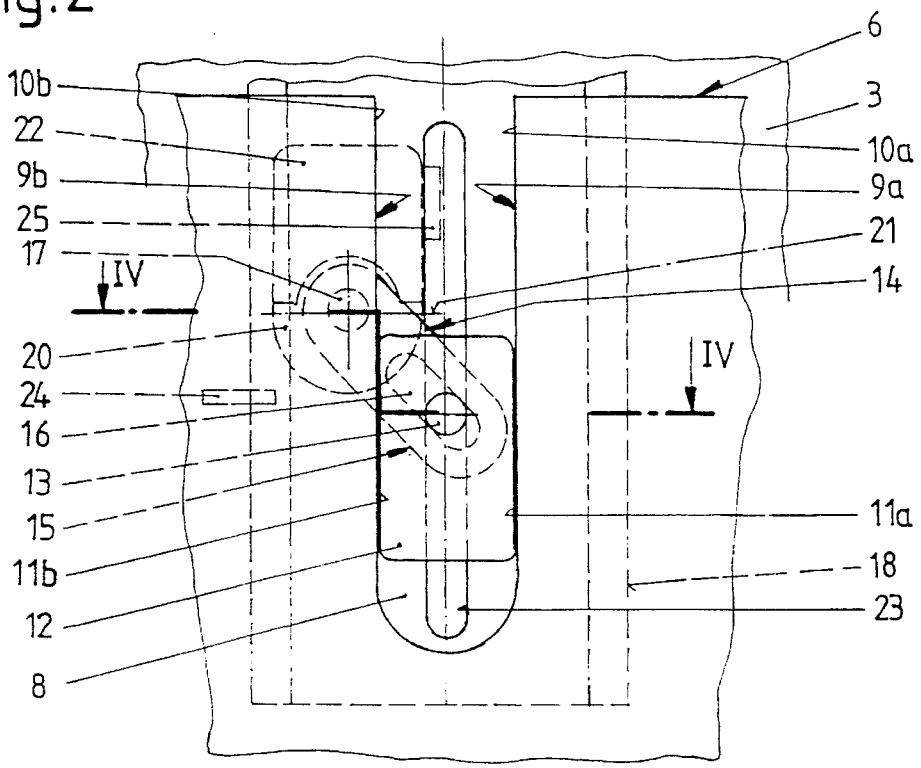
FIGS. 2 and 3 show in an enlarged scale the device for controlling the pivotal resistance in the position with a low resistance (FIG. 2) or in the position with a high resistance (FIG. 3), both viewed from the inside of the boot.
Figure 3:
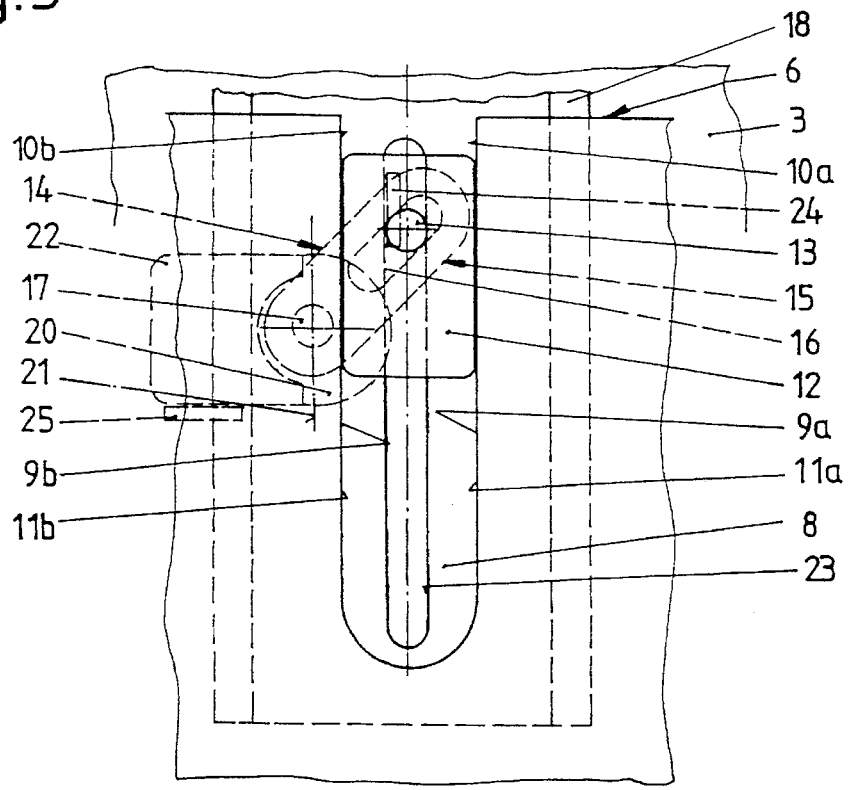

FIG. 2 shows the spacer 12 in its lower position. It contacts thereby the side edges 9*a*, 9*b* of the slot 8 at its lower, thus second sections 11*a*, 11*b*. The first sections 10*a*, 10*b* are free and can move unhindered toward one another during a stress on the raised shell part 6 by the shaft 3 of the boot, thus when the skier assumes a forward position or bends the foot during walking. By rotating the power arm 20 of the crank 14 by means of the operating member 22, the crank 14 is moved into the position shown in FIG. 3. The device 19 is here in its activated position in which the spacer 12 is in its upper position. It contacts thereby the side edges 9*a*, 9*b* of the slot 8 at their first sections 10*a*, 10*b*, which can thus not move toward one another during a stress. Thus an increased resistance counters the forward movement of the skier.

Stops 24, 25 are mounted in this embodiment on the outside of the shaft 3 of the boot, which stops define two positions of the operating member 22 and thus define two positions of the spacer 12 in the slot 8.

Figure 5:
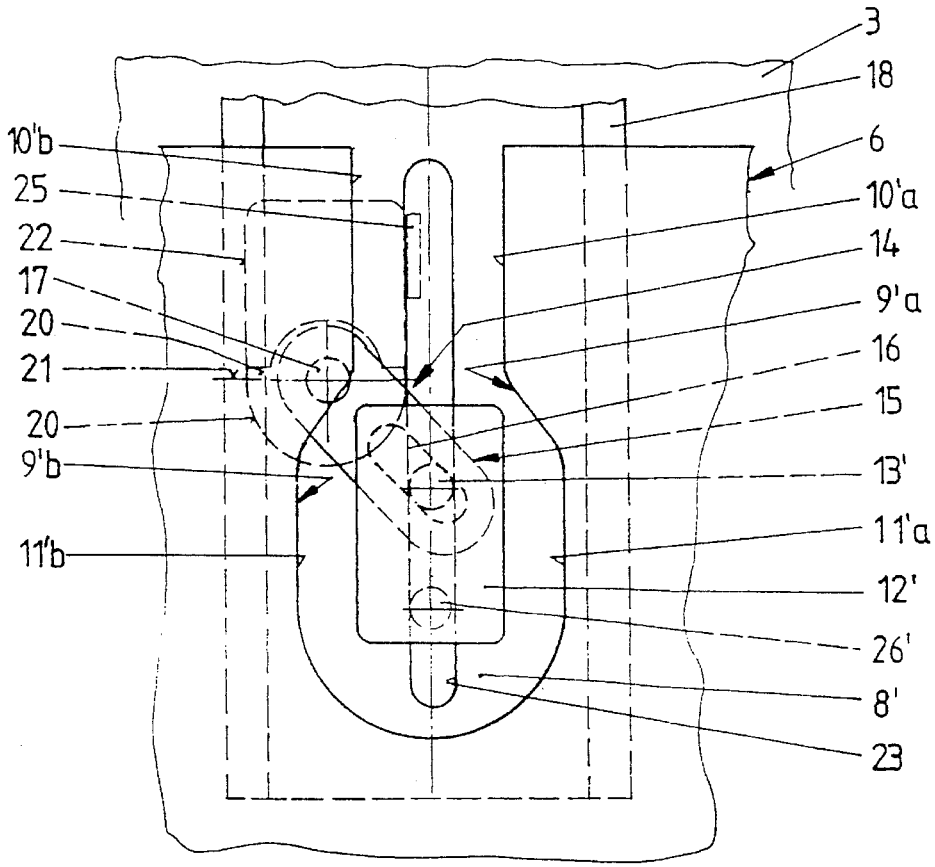
FIG. 5 shows a second embodiment in an illustration similar to the one of FIG. 2.

A second embodiment of the ski boot of the invention is illustrated in FIG. 5. This embodiment differs from the first embodiment according to FIGS. 1 to 4 in that the width of the slot 8' is enlarged in its lower section. Its side edges 9'*a*, 9'*b* have following the first (upper) sections 10'*b*, 10'*b* which extend approximately parallel to one another, contiguous outwardly extending shoulders defining the second (lower) sections 11+*a*, 11'*b* which, with the arc-like bottom wall of the slot, define a U-shape. Thus, the spacer 12' does not rest in its lower position on the side edges 9'*a*, 9'*b* and provides even less resistance than in the first embodiment to counter the forward or walking movement of the skier.

It can also be recognized in FIG. 5 that the spacer 12' carries in its lower half an outwardly projecting peg 26' extending parallel with the pin 13'. This peg 26' is used for keeping the spacer 12' aligned or centered with the slot 8' when it is between the lower sections 11'*a*, 11'*b*. The peg 26' also cooperates with a corresponding groove or recess on the inside of the shaft 3 of the boot or, like in this exemplary embodiment, with the groove 23 in the housing 18 provided for the pin 13.

The invention is not to be limited to the illustrated and described exemplary embodiments. Various modifications exist which by all means lie within the scope of the invention. Thus, it is possible, for example, to design the spacer not only rectangularly, but circularly, ovally or rectangularly with attached circular segments. The operating member can also be designed in one piece with the power arm, in particular when the rear section of the shaft of the ski boot is designed extending in one plane, on which rear section the section of the handle acting as the power arm rests. In place of stops for securing the two positions of the operating member, it could also be possible to provide suitable recesses in the shaft of the boot, into which recesses, and if necessary, spring-loaded detent can be selectively received.

The embodiments of the invention in which an exclusive property or privilege is claimed are defined as follows:

1. A ski boot comprising a shell part and a shaft part hinged to the shell part for the support of a leg of a skier, said shell part having a lower shell part enclosing a foot of the skier and a raised shell part enclosing a lower leg area of the skier, means for providing and controlling a pivoting resistance during a pivoting of the shaft part of the boot relative to the lower shell part, said raised shell part having at a rear side thereof a generally vertically extending slot open at a top end thereof, said slot having spaced side edges which extend at least in sections parallel to one another and between which is received a spacer arranged slidably movably up and down in the slot, and a crank having load arm and a power arm and a rotation axle which is arranged stationarily in the shaft part of the ski boot, said power arm carrying thereon means defining an operating member, said spacer and said crank arm including means for providing a sliding hinged connection therebetween.

2. The ski boot according to claim 1, wherein the operating member supported for movement into a limited number of positions and is held secured against an automatic rotation in each one of these positions.

3. The ski boot according to claim 2, wherein the number of limited positions is two.

4. The ski boot according to claim 3, wherein the two positions into which the operating member can be moved are each defined by means of a stop, wherein the two positions are angularly spaced from one another, the operating member extending horizontally in the one position and vertically in the other position.

5. The ski boot according to claim 1, wherein the spacer is generally rectangular in shape and carries a pin extending in direction of the shaft part of the ski boot, wherein the load arm of the crank is a plate having a slotted hole therein and through which extends the pin to define said means for providing the sliding hinged connection, and wherein the power arm is a flattened plate through which extends the rotation axle about which the operating member is rotated.

6. The ski boot according to claim 5, wherein the pin is received in a groove provided in a housing arranged in the shaft part of the ski boot.

7. The ski boot according to claim 5, wherein the plate is fixedly connected to the axle of the crank as is the operating member at its hub.

8. The ski boot according to claim 5, wherein the slot for the spacer in the raised shell part has, following a first section having said parallel extending side edges, contiguous outwardly extending portions and a further second section in which the side edges and a bottom wall segment of the slot extend in a U-shape, and wherein a peg is arranged on the spacer parallel to the pin, said peg being received in said groove on the housing, which groove is the one in which is also received the pin.

9. The ski boot according to claim 5, wherein the slot for the spacer in the raised shell part has, following a first section having said parallel extending side edges, contiguous outwardly extending portions and a further second section in which the side edges and a bottom wall segment of the slot extend in a U-shape, and wherein a peg is arranged on the spacer parallel to the pin, said peg being received in said groove on the shaft part of the boot, which groove is the one in which is also received the pin.

10. The ski boot according to claim 5, wherein the pin is received in a groove provided in the shaft part of the ski boot.

* * * * *

UNITED STATES PATENT AND TRADEMARK OFFICE

CERTIFICATE OF CORRECTION

PATENT NO. : 5,526,588

DATED : June 18, 1996

INVENTOR(S) : Henry FREISINGER et al.

It is certified that error appears in the above-indentified patent and that said Letters Patent is hereby corrected as shown below:

Column 4, line 36; change "claim 5" to ---claim 6---.

line 45; change "claim 5" to ---claim 6---.

Signed and Sealed this

Twenty-sixth Day of November 1996

*Attest:*

Bruce Lehman

BRUCE LEHMAN

*Attesting Officer*

*Commissioner of Patents and Trademarks*